US006679414B2

(12) United States Patent
Rotharmel

(10) Patent No.: US 6,679,414 B2
(45) Date of Patent: Jan. 20, 2004

(54) INTERCHANGEABLE MAGAZINE FOR A TOOL

(75) Inventor: John M. Rotharmel, Palatine, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/170,991

(22) Filed: Jun. 13, 2002

(65) Prior Publication Data

US 2003/0230622 A1 Dec. 18, 2003

(51) Int. Cl.[7] ..... B27F 7/13

(52) U.S. Cl. ..... 227/120; 227/125; 227/126; 227/136; 227/119

(58) Field of Search ..... 227/8, 10, 120, 227/125, 126, 130, 142, 119, 136

(56) References Cited

U.S. PATENT DOCUMENTS

| | | | | | |
|---|---|---|---|---|---|
| 4,463,888 | A | * | 8/1984 | Geist et al. | 227/109 |
| 4,483,474 | A | * | 11/1984 | Nikolich | 227/8 |
| 4,597,517 | A | | 7/1986 | Wadgy | |
| 4,815,647 | A | * | 3/1989 | Chou | 227/109 |
| 5,005,753 | A | * | 4/1991 | Gravina | 227/120 |
| 5,197,647 | A | * | 3/1993 | Howell | 227/126 |
| 5,263,439 | A | * | 11/1993 | Doherty et al. | 123/46 SC |
| 5,322,189 | A | * | 6/1994 | Oda | 221/227 |
| 5,335,800 | A | * | 8/1994 | Liu | 221/279 |
| 5,433,367 | A | * | 7/1995 | Liu | 227/120 |
| 5,687,899 | A | * | 11/1997 | Dohi et al. | 227/10 |
| 5,839,638 | A | * | 11/1998 | Ronn | 227/8 |
| 6,012,622 | A | * | 1/2000 | Weinger et al. | 227/8 |
| 6,053,389 | A | * | 4/2000 | Chu et al. | 227/120 |
| 6,131,787 | A | | 10/2000 | Curtis | |
| 6,176,412 | B1 | | 1/2001 | Weinger et al. | |

FOREIGN PATENT DOCUMENTS

| | | |
|---|---|---|
| AU | 730883 | 12/1999 |

* cited by examiner

*Primary Examiner*—Scott A. Smith
*Assistant Examiner*—Chukwurah Nathaniel
(74) *Attorney, Agent, or Firm*—Lisa M. Soltis; Mark W. Croll; Donald J. Breh

(57) ABSTRACT

The present invention provides a tool for driving a fastener from a detachable magazine. The tool includes a tool housing having a proximal end and a distal end and a power source enclosed by the housing. A nosepiece is attached to the housing and has a channel and a first alignment structure. The magazine is removably attached to the tool and has a magazine housing and a shear block that is mounted to the proximal end of the magazine housing. There is a second alignment structure and a face on the shear block such that the channel and the face form a barrel when the first alignment structure is engaged with the second alignment structure and the magazine is removably attached to the tool. Upon firing of the tool, the fastener is propelled by the power source, through the barrel and into the workpiece.

22 Claims, 6 Drawing Sheets

INTERCHANGEABLE MAGAZINE FOR A TOOL

BACKGROUND OF THE INVENTION

This invention relates to portable combustion powered fastener driving tools, and more specifically to an interchangeable magazine for such a power tool.

Portable combustion powered tools for use in driving fasteners into workpieces are described in commonly assigned patents to Nikolich, U.S. Pat. Nos. Re. 32,452; 4,403,722; 4,483,473; 4,483,474; 4,552,162; 5,197,646 and 5,263,439, all of which are incorporated herein by reference. Such combustion powered tools particularly designed for trim applications are disclosed in commonly assigned U.S. Pat. No. 6,016,622, also incorporated by reference herein. Similar combustion powered nail and staple driving tools are available from ITW- Paslode under the IMPULSE® brand.

Such tools incorporate a generally pistol-shaped tool housing enclosing a small internal combustion engine. The engine is powered by a canister of pressurized fuel gas also called a fuel cell. A battery-powered electronic power distribution unit or electronic sending unit produces the spark for ignition, and a fan located in the combustion chamber provides for both an efficient combustion within the chamber, and facilitates scavenging, including the exhaust of combustion by-products. The engine includes a reciprocating piston having an elongate, rigid driver blade disposed within a piston chamber of a cylinder body.

A wall of the combustion chamber is axially reciprocable about a valve sleeve and, through a linkage, moves to close the combustion chamber when a workpiece contact element at the end of a nosepiece, or nosepiece assembly, connected to the linkage is pressed against a workpiece. This pressing action also triggers the introduction of a specified volume of fuel gas into the combustion chamber from the fuel cell.

Upon the pulling of a trigger, which causes the ignition of the gas in the combustion chamber, the piston and the driver blade are shot downward to impact a positioned fastener and drive it into the workpiece. As the piston is driven downward, a displacement volume enclosed in the piston chamber below the piston is forced to exit through one or more exit ports provided at a lower end of the cylinder. After impact, the piston then returns to its original or "ready" position through differential gas pressures within the cylinder. Fasteners are fed into the nosepiece barrel from a supply assembly where they are held in a properly positioned orientation for receiving the impact of the driver blade. The fasteners are then propelled through the length of the barrel by the driver blade, exiting the barrel at the workpiece surface. Force of the driver blade and the momentum of the fastener drive the fastener to penetrate the workpiece.

A convenient manner of supplying fasteners is through a magazine that feeds them in succession to the barrel. When the magazine is emptied, it is detached from the nail gun, refilled and reinstalled to continue the job. Multiple magazines are often used so that the tradesman can continue working while the magazines are refilled by an assistant or stored for later replenishment. It is often necessary to change from among many different types of fasteners. Nails, for example, may be normal or Positive Placement®, clipped head, Roundrive® or of various lengths. The geometry of the magazine and the shear area that holds the fastener in a proper orientation to receive the impact of the driver blade determines the type of fastener that is appropriate with a particular magazine or shear area.

Firing of the tool produces a great deal of shock and vibration when the driver blade strikes the fastener, driving it into the workpiece. Screws in the vicinity of the shear area tend to work loose from the vibration, frequently requiring tightening to keep the component parts properly aligned. For this reason, magazines have generally been of one-piece construction. Prior art, multi-piece magazines have been fastened with screws adjacent the shear block. In many cases, the screws holding the side rails of the magazine together loosen due to repeated vibration over time. The user of such a magazine must periodically check the magazine to determine if the fasteners need to be tightened. This monitoring requirement is at best inconvenient.

One-piece magazines have been used in the art in an attempt to eliminate disassembly of the magazine. However, units made of a single piece were found to be either very heavy or expensive to manufacture. Windows in the sides of the magazine reduce the weight as well as allow the user to visually confirm operation of the magazine. A single-piece magazine cannot easily be stamped, punched or molded to create the windows and the hollow interior through which the fasteners pass. More expensive fabrication techniques have to be employed to manufacture magazines of this type.

Although they may have detachable magazines, prior art combustion powered tools are not necessarily convertible to handle different sizes or kinds of fasteners. Because the shear area guides the fastener into the barrel, the type of fasteners that can be used is determined by the shear block that surrounds the shear area and is a permanent part of the tool. Detachable magazines can be used to provide a convenient supply of fasteners, but as long as the shear area does not change, the size and shape of the fastener head cannot change from one magazine to another.

It is known in the art to accommodate changes in the length of the fastener by actuating a lever. If the user forgets to move the lever, or places it in the wrong position, the fastener can jam in the barrel of the tool. The barrel must then be opened to clear the jam before work can be resumed. It is contemplated that the use of a lever to accommodate changes in the fastener diameter or the shape of the head would have similar results.

Inclusion of the shear block on the tool can render the tool unusable if the shear block is damaged. If repair or replacement of the shear block is necessary, the entire tool is unusable during the repair time, requiring that the user have another tool as a backup, or else reschedule the workload until the tool becomes available.

Thus, there is a need in the art for a detachable magazine for a tool that accommodates fasteners of different sizes and types. There is also the need for a magazine that does not have screws in the vicinity of the shear block that could loosen due to vibration. Finally, there is a need for a tool to accommodate a magazine with an integrated shear block and where the shear block can be changed merely by attaching a different magazine to the tool.

SUMMARY OF THE INVENTION

The present invention features a detachable magazine for a power tool that is interchangeable with similar magazines holding fasteners of different sizes or types for use with the same tool.

More specifically, the present invention provides a tool for driving a fastener from a detachable magazine. The tool includes a tool housing having a proximal end and a distal end and a power source enclosed by the housing. A nosepiece is attached to the housing and has a channel and a first alignment structure. The magazine is removably attached to the tool and has a magazine housing and a shear block that is mounted to the proximal end of the magazine housing. There is a second alignment structure and a face on the shear block such that the channel and the face form a barrel when the first alignment structure is engaged with the second alignment structure and the magazine is removably attached to the tool. Upon firing of the tool, the fastener is propelled by the power source, through the barrel and into the workpiece.

As fasteners move from the magazine into the barrel, they pass through the shear block, which is shaped for fasteners of specific size and type to aid in properly aligning the fastener in the barrel for firing. Mounting of the shear block onto the magazine allows the shear block to be replaced each time the magazine is changed, allowing for rapid conversion to different fasteners. Valuable time is not wasted manually checking lever positions, changing levers or clearing jams if incompatible lever positions are selected.

In a preferred embodiment, a magazine of two-piece construction is used. The magazine housing is made of a first side rail and a second side rail that matingly engage with one another. The shear block is held between the proximal ends of each of the first and second side rails when the first and second side rails are removably attached to each other.

Two-piece construction of the magazine has many advantages over the prior art. Windows, located in each rail to make it lighter, can be die punched when there is only a single thickness of material. A one-piece magazine cannot be die punched. The windows are generally obtained by machining each window, resulting in more labor and higher costs. When each side rail is die punched prior to assembly, the magazine can be made lighter and more quickly at a lower cost compared to a single piece magazine. Additionally, the two-piece magazine can be more economical to repair since each side rail can be independently replaced.

The magazine is easily assembled by a tongue on one side rail in a groove on the bottom edge of the second side rail, then applying fasteners to the top of the magazine. When fasteners are used to hold the magazine together in the vicinity of the barrel, they become loose due to the shock and vibration at each firing of the tool. Use of tongue and groove assembly holds the magazine together in a manner that does not come loose. The magazine is also easier to assemble because fewer fasteners are needed for its construction.

DETAILED DESCRIPTION OF THE DRAWINGS

DETAILED DESCRIPTION OF THE INVENTION

Figure 1:
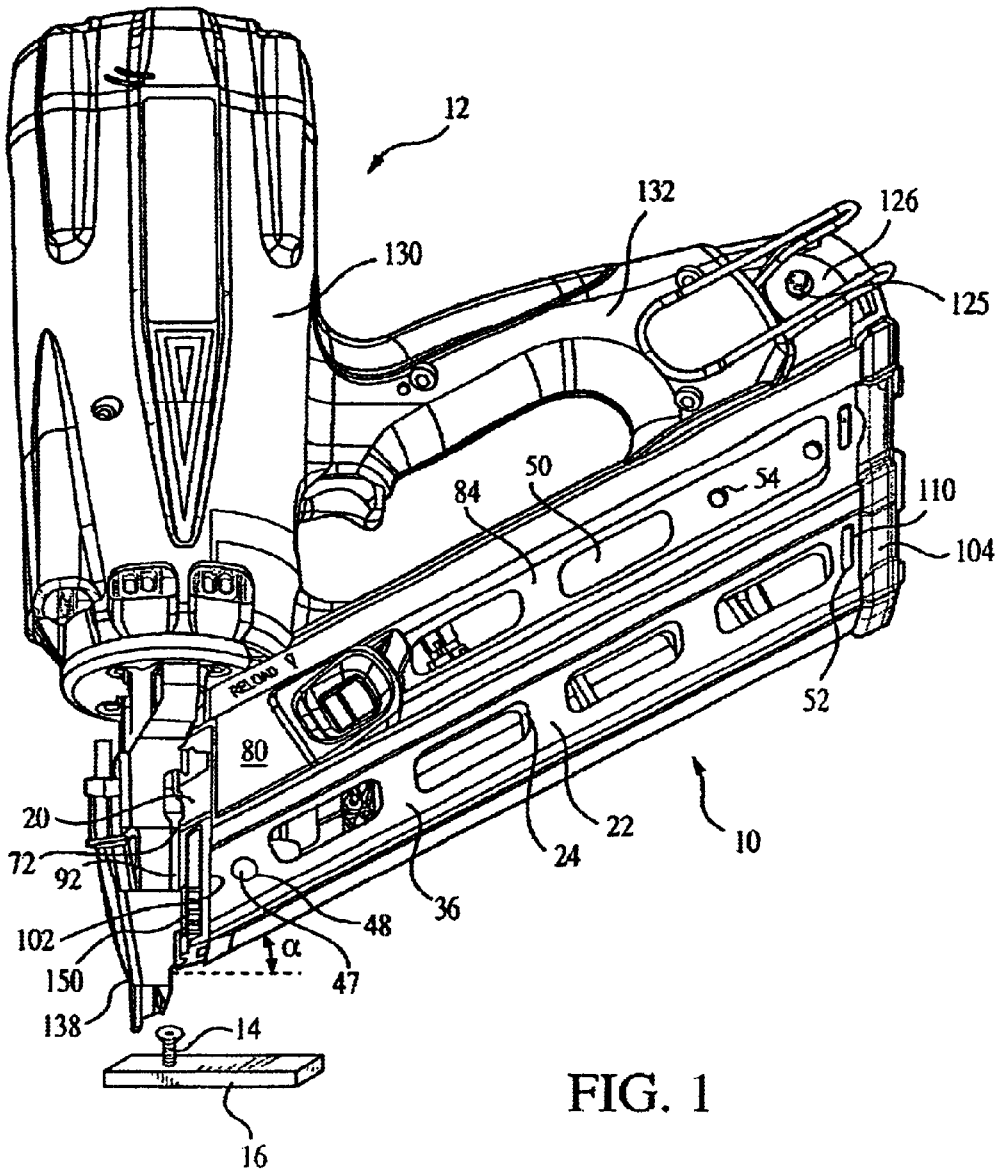
FIG. 1 is a front perspective view of the present tool.

Referring to FIG. 1, an interchangeable magazine generally designated 10, is designed for use in a tool, generally designated 12, for driving fasteners 14 into a workpiece 16. Many different types of fasteners 14 are useful with a tool 12 of this type, any of which are suitable. Common nails 14 of various lengths are used, as well as clipped nails and positive placement nails, which are designed to penetrate a metal frame in addition to a stud. The term "nail" is used in the remainder of the discussion to distinguish the fasteners 14 that are driven by the tool from other fasteners that are part of the tool itself Use of this term is not intended to limit the choice of fasteners 14 that can be used with the tool 12 in any way. When the fasteners 14 are loaded into the magazine 10, all of the fasteners in each of the magazines are alike.

The magazine 10 shown in FIG. 1 includes a shear block 20 and a magazine housing 22. Preferably, the shear block 20 and the magazine housing 22 are separately constructed, however, the use of a housing 22 with an integral shear block 20 is contemplated for use with the present magazine 10.

In one embodiment shown in FIGS. 2–5, the magazine housing 22 is of a two-piece construction. A first side rail 24 has a top edge 26, a bottom edge 30, a proximal end 32 and a distal end 34. A second side rail 36 has a top edge 40, a bottom edge 42, a proximal end 44 and a distal end 46. The second bottom edge 42 is removably attachable to the bottom edge 30 of the first side rail 24 without the use of a fastener. The shear block 20 is held between the proximal ends 32, 44 of each of the first and second side rails 24, 36 when the first and second side rails are removably attached to each other. The shear block 20 has a first positioning element 47 that is engagable with a second positioning element 48 on at least one of the first and second side rails 24, 36. Optionally, at least one closing device 49 holds the top edge 26 of the first side rail 24 to the top edge 40 of the second side rail 36 when the first and second positioning elements 47, 48 are engaged with each other and the shear block 20 is sandwiched between the first and second side rails 24, 36.

The first and second side rails 24, 36 preferably are made of an extruded aluminum construction. Metals are the preferred materials of manufacture as they are relatively inexpensive, sturdy and easily formed into a desired shape. Aluminum is a preferred metal due to its light weight, however, other metals, such as steel, particularly stainless steel, are contemplated. Use of other materials, particularly plastics, is also contemplated for manufacture of the side rails. Most preferred materials are those that allow windows 50, cavities 52, openings 54 or other details to be die punched or molded into each of the side rails, 22, 36 decreasing manufacturing cost compared to machining of such details. Although extrusion is a preferred method of making the side rails 24, 36 due to its low cost, any method of making the side rail can be used that is suitable for use with the material of manufacture.

Figure 3:
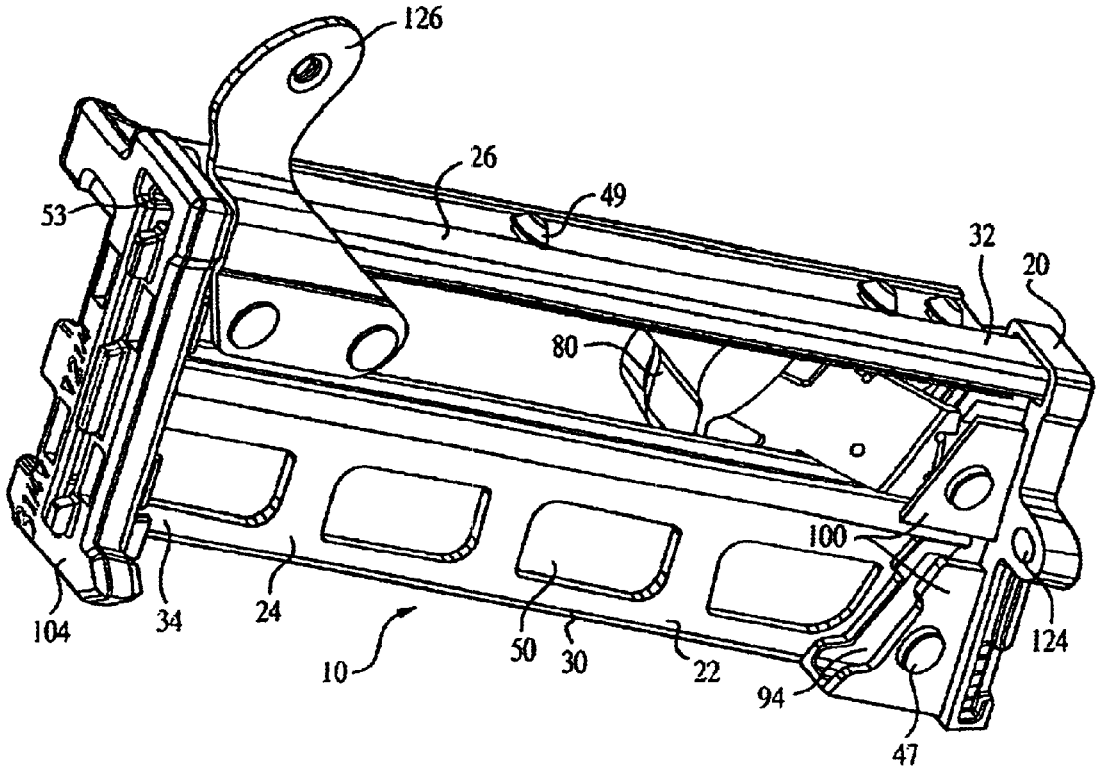
FIG. 3 is a rear perspective view thereof with the second side rail removed.

The proximal end 32, 44 is the end that is closest to the workpiece 16 when the magazine 10 is installed on the tool 12 for use. At the opposite end, the distal end 34, 46 is the end from which nails 14 are loaded into the magazine 10, typically through a "T"-shaped slot 53 (FIG. 3). When the magazine 10 is assembled, the proximal end 32 of the first side rail 24 is adjacent the proximal end 44 of the second side rail 36 and the distal end 34 of the first side rail 24 is adjacent the distal end 46 of the second side rail 36. As the nails 14 held within the magazine 10 are used successively, each nail is urged from the distal end 34, 46 toward the proximal end 32, 44, as is known in the art, such as by a spring-biased follower described below.

When the magazine 10 is on the tool 12 ready for use on the workpiece 16, the bottom edge 30, 42 runs from the proximal ends 32, 44 closest to the workpiece 16, to the distal ends 34, 46. The top edge 26, 40 runs opposite the bottom edge 30, 42, from the proximal ends 32, 44 to the distal ends 34, 46. The top edge 26, 40 is further from the workpiece than the bottom edge 30, 42.

Figure 4:
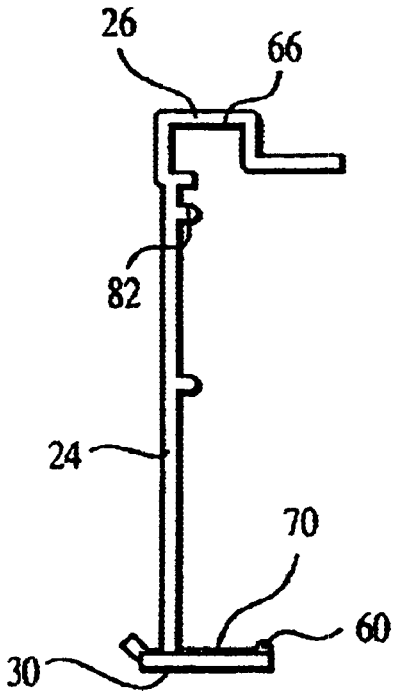
FIG. 4 is a side view of the first side rail.
Figure 5:
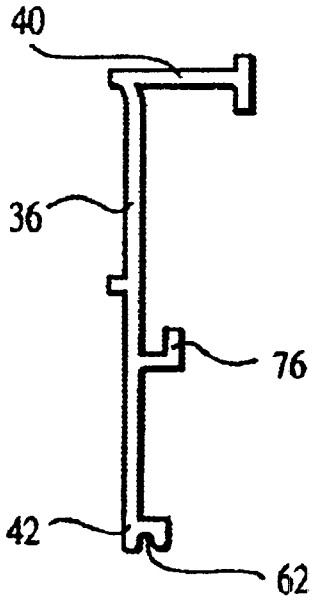
FIG. 5 is a side view of the second side rail.
Figure 5A:
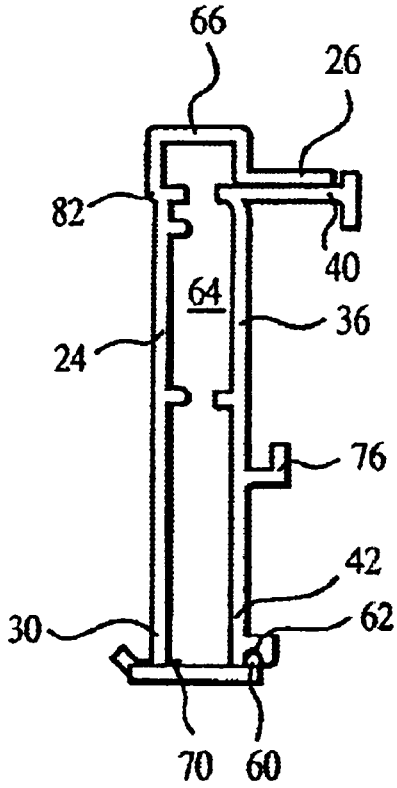
FIG. 5A is a side view of the first and second side rail with the bottom edges matingly engaged.

As best seen in FIGS. 4, 5 and 5A, the bottom edges 30, 42 of the first and second side 24, 36 rails are releasably attachable to each other without the use of fasteners. In one embodiment, the bottom edges 30, 42 are releasably attached to each other by a complementary tongue 60 and a groove 62 engagement. The tongue 60 along the bottom edge 30 of the first side rail 24 matingly engages with the groove 62 along the bottom edge 42 of the second side rail 36. Although shown in this arrangement, the magazine 10 would operate equally well with the tongue 60 on the second side rail 36 and the groove 62 on the first side rail 24. Preferably the tongue 60 and the groove 62 run along the entire length of the side rails 24, 36, but this length is not necessary as long as there is sufficient complementary engagement between the tongue 60 and groove 62 to hold the two side rails 24, 36 together under the stress of repeated firings of the tool 12.

Still referring to FIGS. 4, 5 and 5A, a plurality of the fasteners 14 is designed to fit inside the magazine 10, requiring that the magazine have an interior cavity 64 of sufficient size to hold the fasteners. The depth of the magazine 10 is defined by a top wall 66 and a bottom wall 70. As shown, the top wall 66 and the bottom wall 70 are both a part of the first side rail 24, although many equally satisfactory arrangements are possible. The top wall 66 could be made as part of one of the side rails 24, 36 and the bottom wall could be part of the other side rail or both top 66 and bottom 70 wall could be formed from the second side rail 36. Any arrangement that provides sufficient space in the interior cavity 64 for insertion and movement of nails 14 toward the tool 12 is suitable for use with this invention.

Figure 2:
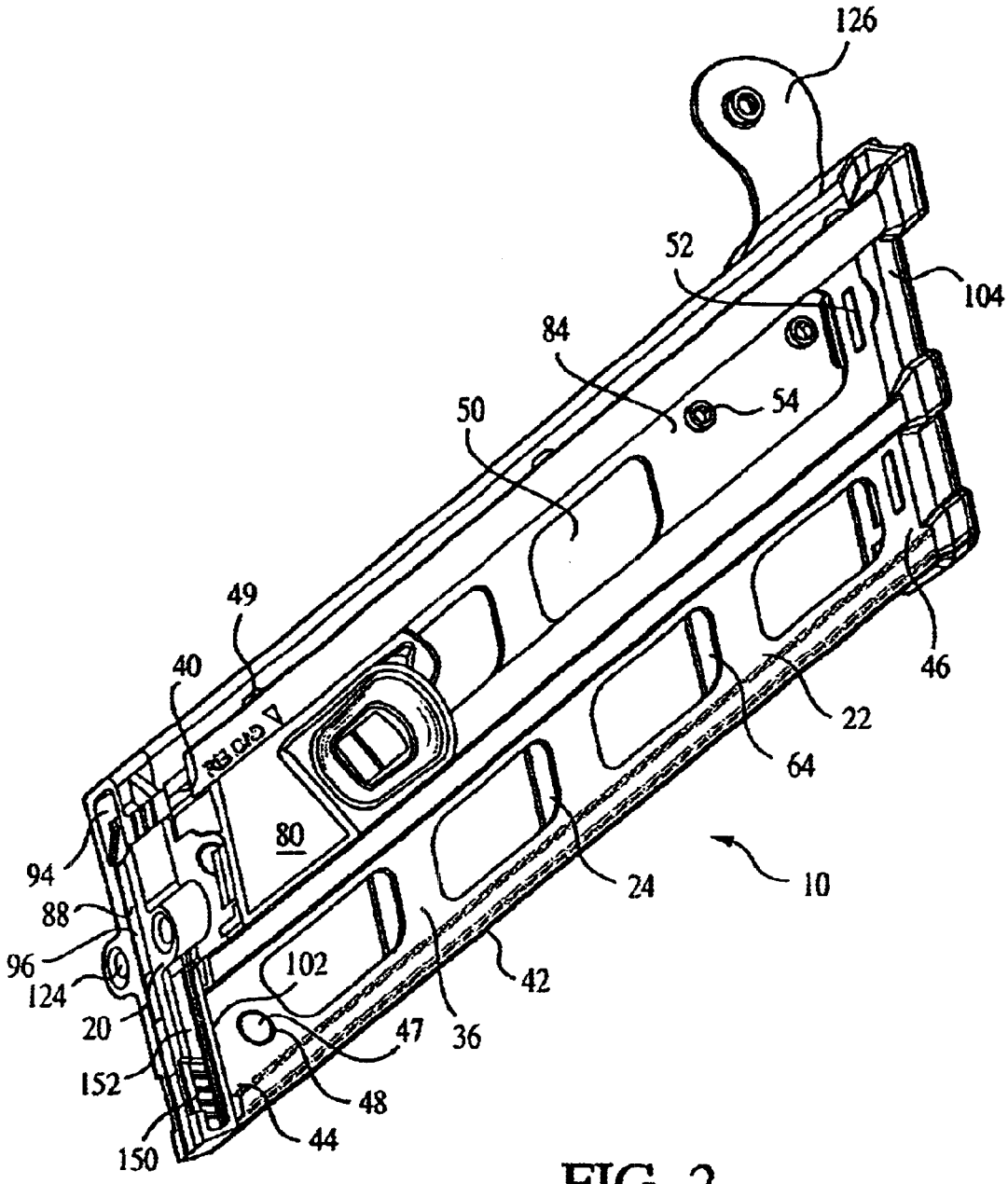
FIG. 2 is a front perspective view of the magazine of FIG. 1.

As seen in FIGS. 1 and 2, when installed in the tool 12 for use, the magazine 10 is at an angle, $\alpha$, relative to a barrel 72 with the distal end 34, 46 of the magazine 10 higher, that is at a greater distance from the workpiece 16, than the proximal end 32, 44. This arrangement allows gravity to assist the movement of the nails 14 toward the 12. Angles for installation of the magazine 10 are well known to those skilled in the art, however, the angle, $\alpha$, preferably is within the range of between 20° and 40°.

The optional windows 50 are cut into the side rails 24, 36 to reduce the weight of the rails 24, 36 and to allow the user to view movement of the nails 14 within the magazine 10. If, for example, the fasteners 14 jam inside the magazine 10, the jam can be observed from outside the magazine, preventing the user from having to completely disassemble the magazine.

The magazine 10 is held together with at least one of the closing devices 49 along the top edge 26, 40 of each of the first and second side rails 24, 36. Preferably, the closing device 49 (FIG. 2) is one or more screws that are located toward the distal end 34, 46 of the side rails 24, 36. This arrangement places the screws 49 at a distance away from the proximal end 32, 44 of the side rails 24, 36 where they are less likely to vibrate due to shock of impacting and driving the nail 14, leading to less vibration and loosening of the screws 49.

Referring back to FIGS. 2, 4, 5 and 5A, a track 76 is preferably extruded into the exterior of the second side rail 36. A follower assembly 80 (FIG. 2) slides along the track as the nails 14 are fed into the tool 12. The follower assembly 80 is well known to those skilled in the art. One of the preferred follower assemblies 80 is held on the track 76 on the exterior of the second side rail 36 and pushes the nails 14 through the magazine 10 from the distal end 46 toward the proximal end 44. The first side rail 24 and the second side rail 36 are sized and configured to hold a plurality of nails 14 between them. A "C" channel 82 (FIG. 4) on the first side rail 24 guides the nails 14 through the interior cavity 64 along the length of the magazine 10 by engaging the nail heads. At least one full-length window 84 preferably runs substantially the length of the magazine 10 for the purpose of allowing a portion of the follower assembly 80 to reach the nails 14 inside the magazine, pushing them toward the tool 10. When the magazine 12 has been emptied, the follower assembly 80 can be reset to the distal end 46 of the magazine 10 and the magazine refilled with nails 14. Preferably, the nails 14 are supplied in the form of a nail strip 86 (FIG. 6), which typically includes a plurality of nails applied to a paper or plastic strip. The strip 86 holds the nails 14 in an appropriate position to move along the interior cavity 64, sequentially being fed into the barrel 72 for discharge into the workpiece 16.

Turning now FIGS. 2–6, the shear block 20 is held between the first and second side rails 24, 36 at the proximal end 32, 44 of the magazine 10. When the magazine 10 is installed on the tool 12, a face 88 on the shear block 20 adjoins a channel 90 on a nosepiece 92. The face 88 and the channel 90 are shaped and configured to form the barrel 72 through which the fasteners 14 travel as they are being driven into the workpiece 16. As they move from the magazine 10 into the barrel 72, the nails 14 move through a shear area 94 (FIG. 2) and through an opening 96 in the shear block 20 adjacent the nosepiece 92.

The shear area 94 is shaped to receive nails of a specific size or type. Use of nails 14 not intended for use with a particular shear block 20 leads to jamming of the tool 12 due to nails 14 that do not feed properly because the shear area 94 is not the correct size or shape. If nails 14 are too large for the shear block 20, they will block passages where they are too tall or too wide to pass. In the case where the nails 14 are too small, nails can rebound off the side of the barrel 72, partially reentering the shear area 94 by the time a driver blade (not shown) begins its descent. Impact of the driver blade on the nail 14 then pushes it downward, even though it is partially located in the shear area 94 of the shear block 20, wedging it between the shear block 20 and the barrel 72 and jamming the tool 12.

Jamming is reduced by adopting the present invention because the shear block 20 is carried with the magazine 10, not the tool 12. Changing the shear block 20 to accommodate an assortment of nails 14 is simple with the present invention 10. The shear block 20 is installed in the magazine 10 by placing the opening 96 adjacent the barrel 72 of the tool 12. Correct placement of the shear block 20 against the first or second side rail 24, 36 is assisted by at least one of the first positioning elements 47 and the second positioning elements 48. The first positioning element 47 is located on a portion of the shear block 20 that will be in contact with the first or second side rail 24, 36 when the magazine 10 is assembled. Preferably, the first positioning element 47 is a boss or other projection. The second positioning element 48 is located on either the first or second side rail 24, 36, shaped and positioned to matingly engage the first positioning element 47. While a hole is depicted, any window, opening, cavity or detent is suitable as the second positioning element 48 so long as it captures the first positioning element 47 when it is properly located and holds the shear block 20 in the proper position.

In a preferred embodiment, multiple first positioning elements 47 mate with multiple second positioning elements 48 to hold the shear block 20 at the desired location with a high degree of stability. The vibration and shock that pulsates through the shear block 20 with every firing of the tool 12 attempts to dislodge the block. A friction fit of the shear block 20 between the first and second side rails 24, 36, and the use of multiple positioning devices 47, 48 to increase the friction, ensures stable placement of the shear block 20 and a reduction in jams or wear due to movement of the block.

The shear block 20 is made of any material that will withstand the forces exerted when the tool 12 is fired. Metals are preferred materials of manufacture, including but not limited to aluminum or steel. The metals are optionally treated to harden them, reduce rust or impart other desirable properties. Most preferably, the shear block is made of investment cast steel. Other materials are also contemplated for manufacture of the shear block 20 including high temperature or high strength polymers, ceramics and any other material suitable for this application.

Figure 6:
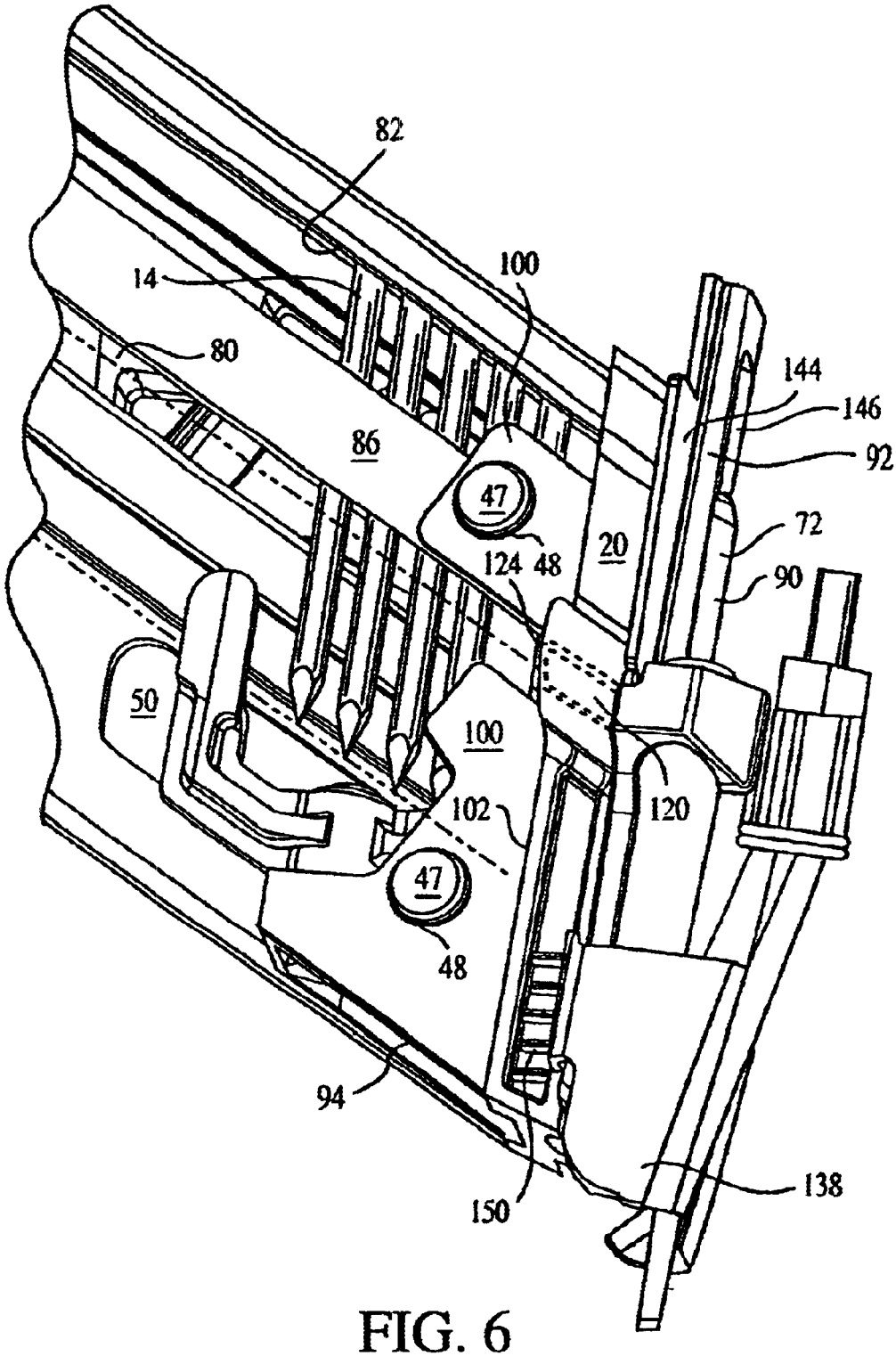
FIG. 6 is a fragmentary perspective view of the shear block and nosepiece of FIG. 2.

As seen in FIGS. 3 and 6, the shear block 20 preferably includes one or more legs 100 (FIG. 6) to improve the stability of the shear block 20 and to provide a convenient location for the first positioning element 47, particularly where a plurality of first positioning elements are used. The leg 100 is shaped to be sandwiched between the first side rail 24 and the second side rail 36 when the magazine 10 is assembled. When the shear block 20 is installed in the magazine, the leg 100 extends from the shear block 20 inside the magazine 10 toward the distal end 46. If any part of the leg 100 is in the shear area 94, it is shaped to allow the nails 14 to pass from the interior cavity 64 to the barrel 72 without interference. Preferably, the shear area 94 is housed inside the leg 100, such that the leg is hollow.

Referring to FIGS. 1 and 3, one or more of the first positioning elements 47 is located on at least one leg 100. Placement of the first positioning element 47 on the leg 100 allows placement of the second positioning element 48 away from an edge 102 (FIG. 1) at the proximal end 32, 44 of the side rail 24, 36. If the second positioning element 48 is a window or slot, it must be placed a distance from the edge 102 so that it is completely enclosed by the side rail 24, 36. Locating the second positioning element 48 away from the edge 102 allows more side rail 24, 36 area for flexibility in the shape and orientation of the second positioning element 48 and moves the positioning elements 47, 48 away from the source of vibration.

Installation of the shear block 20 is easily accomplished by aligning the first and second positioning elements 47, 48 between the shear block 20 and the first and second side rails 24, 36, aligning the tongue 60 and the groove 62 of the first and second side rails, then applying the closing device 49 to the magazine to hold it together. The ease with which the shear block 20 installs makes it convenient to change shear block when a change in nail 14 size or type is needed.

Figure 7:
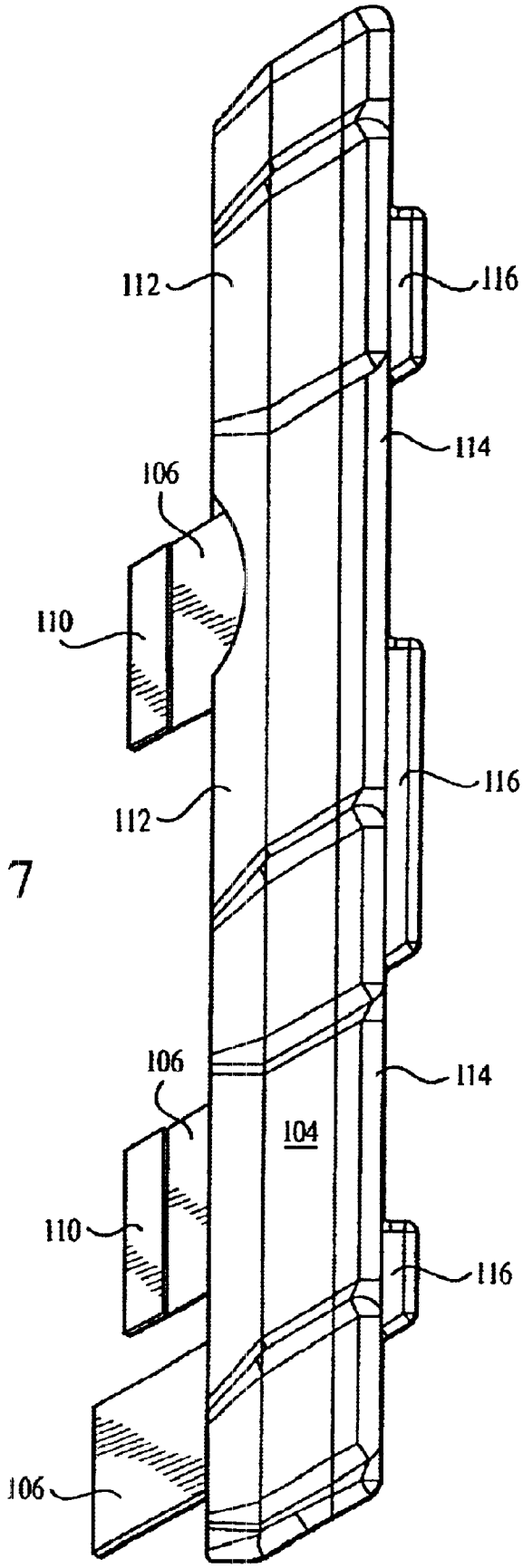
FIG. 7 is a front view of the endcap.

Referring now to FIGS. 1–3 and best seen in FIG. 7, at the distal end 34, 46, an optional endcap 104 covers the end of, and is removably attached to, the first and second side rails 24, 36 of the magazine 10. The endcap 104 protects the distal end 34, 46 and aids the insertion of the nail strip 86 into the magazine 10. Any method of attaching the endcap 104 to the magazine 10 can be used, including the use of friction fit and fasteners. Preferably, the endcap 104 has at least one flexible prong 106 with a lock 110. The prong 106 is sized to fit inside the magazine 10 without interfering with the movement of the nails 14 therein, and positioned such that the lock 110 engages with one of the windows 50 in either the first or second side rail 24, 36. When the magazine 10 is to be refilled, pushing on the lock 110 toward the interior cavity 64 causes the prong 106 to flex, allowing the lock to move clear of the window 50 with which it was engaged. The endcap 104 is then removed by pulling it outward, away from the magazine 10. Most preferably, the endcap 104 includes a plurality of prongs 106 that lock onto a plurality of windows 50 on the side rails 24, 36. When snap-fit into place, the end cap 104 helps to hold the first and second side rails 24, 36 of the magazine 10 together, adding stability at the distal end of the magazine. If the fit is sufficiently snug, it is envisioned that the endcap 104 holds the magazine 10 together, eliminating the need for fasteners to hold the first and second side rails 24, 36 together.

The preferred endcap 104 is shaped to have a tapered side 112 that is adjacent the magazine 10 when the endcap is installed and a wide side 114 opposite the tapered side. The prongs 106 extend outward from the tapered side 112 for insertion into the interior cavity 64. Insertion of the nail strip 86 into the wide side 114 of the endcap 104 is assisted by the presence of one or more shelf units 116 that extend outwardly from the wide side that guide and support the nail strip.

Turning to FIG. 6, at the proximal end 46 of the magazine 10, the shear block 20 includes an attachment structure 120 to precisely position the magazine on the tool 12 such that the opening 96 (FIG. 1) aligns with the barrel 72 to sequentially feed the nails 14 from the magazine into the barrel. While use of any attachment structure 120 known in the art is contemplated, preferably, the attachment structure is a plurality of locating pins on the nosepiece 92 that interface with holes 124 in the shear block 20.

Referring to a bracket 126 (FIG. 2) at the distal end 34, 46 of the magazine 10 attaches to the tool 12, holding the shear block 20 and the magazine 10 firmly in place. If the magazine 10 jams, the bracket 126 can be loosened so that the magazine pivots about the attachment structure 120, partially opening the barrel 72. Some jams can be cleared when the magazine 10 is in this position more quickly and easily than removal of the entire magazine. Tightening of the attachment structure 120 allows the user to get the tool 12 back into operation with a minimum of down time.

Referring again to FIG. 1, with the magazine 10 in place, the tool 12 can be used to drive fasteners 14 into a workpiece 16. General design and operation of a tool is well known to those skilled in the art, and described in the patents previously incorporated by reference. A power source 130 is located within a tool housing 132. The nosepiece 92 is attached to the tool housing 132, adjacent to the magazine 10. Placement of the magazine 10 forms the barrel 72 from the face 88 and the channel 90. The fasteners 14 move from the interior cavity of the magazine 64, through the shear area 96 and into the barrel 72. Power from the power source 130 energizes a driver blade (not shown) that propels the fastener 14 through the barrel 72 and into the workpiece 16.

To take full advantage of the ability to change fastener types at times necessitates other changes to the tool 12. For ordinary nails 14, a unitary aluminum nosepiece 92, is commonly used. When certain types of the fasteners 14 are employed, alternate workpiece contact elements 138 are employed, some of which are heavier than others. Generally, the preferred material of manufacture for the nosepiece 92 is aluminum because of its light weight, but it is not strong enough to support one of the heavier workpiece contact elements 138. In these cases, it is convenient to utilize a steel nosepiece 92.

Now referring to FIG. 6, the optional nosepiece 92 can be utilized with any of the workpiece contact elements 138 because it is split into two parts, a front wear plate 144 and a rear wear plate 146. The front wear plate 144 holds the work contact element 138 and is made of steel, while the rear wear plate 146 can be made of a lighter weight material such as aluminum or hardened sheet metal to prevent the tool 12 from becoming too heavy. Use of the split nosepiece 92 with the magazine 10 of this invention, provides a degree of flexibility for a tool 12 through interchangeability of the magazine 10 and shear block 20 as well as the rear plate 146, work contact element 138.

The preferred nosepiece 92 has a rear wear plate 146 that is detachable for replacement if a nail 14 of a different type is used. Nails 14 come in a number of varying diameters and head styles. Round head nails 14 have a circular top, while clipped nails have D-shaped heads. When using clipped nails 14, the rounded portion of the head enters the barrel 72 and rests at approximately the same position as the round nail. However, since the head has a flat side, the driver blade comes very close to the edge on the flat side. If either the nail 14 or the driver blade are out of position, it can cause the driver blade to miss the flat edge of the head, missing the nail 14 altogether and jamming the tool 12. Changing of the rear wear plate 146 to have a more shallow channel 90 prevents the nail 14 from resting as deeply in the channel. The nail head is more centered with respect to the driver blade, decreasing the probability that the driver blade will miss the nail 14. In one embodiment of the present invention, the depth of the channel 90 for round head nails was 0.032 inch, while the depth of the channel for the clipped head nails was 0.012 inch. Although this feature was described in terms of round head and clipped nails 14, it can be used with a number of types of nails, as will be apparent to an artisan in this field.

Several optional features can be added to the magazine 10 of this invention for the convenience of the user of the tool 12. As seen in FIG. 2, lines or hash marks 150 can be added to the magazine 10 to indicate the depth to which the fastener will be driven. Preferably the marks 150 are included on the shear block 20. As the nail 14 enters the shear block 20, it is visible through an optional opening 152 on the side of the shear block 20. The marks 150 are partially obscured by the length of the fasteners 14 while the tool 12 is in use. Length of the fasteners 14 in the magazine 10 are judged by the number of marks 150 visible beyond the length of the fastener.

Referring to FIGS. 2–5, the magazine 10 is assembled by engaging the first positioning element 47 on the shear block 20 with the second positioning element 48 on at least one of the side rails 24, 36, the shear block 20 being selected based on compatibility with the type of fasteners 14 to be used. Next, the tongue 60 is inserted in the groove 62 at the bottom edges 30, 42, and the top edges 26, 40 are brought together, sandwiching the shear block 20 between the two sides 22, 36. The sides 22, 36 are held together by the installation of either the closing device 49, the end cap 104 or both. Installation of the end cap 104 includes inserting the prongs 106 of the tapered side 112 until the lock 110 engages with a window 50 or other opening 52 in one of the side rails 24, 36. The nails are inserted into the interior cavity 64 of the magazine 10 through the end cap 104, preferably supporting the nail strip 86 on the shelf 116 as it enters the magazine 10. If it is necessary to change the shear block 20, the above process is reversed, a different shear block is used, and the magazine is reassembled.

As the nails 14 move through the interior cavity 64, they pass through the shear block 20 at the shear area 94, which is shaped to accommodate the nail. After passing through the shear area 94, the nail enters the barrel 72 of the tool 12. Upon firing of the tool 12, power from the driver blade travels downward, pushing the nail 14 the length of the barrel 72 and into the workpiece 16.

Referring now to FIG. 6, the magazine 10 is installed on the tool 12 by mating the locating pins 120 on the nosepiece 92 with holes 124 on the shear block 20. At the distal end of the magazine 10, the mounting bracket 126 attaches to the tool 12 at fastener 125. Some jams can be cleared by releasing the mounting bracket 126, allowing the magazine 10 to pivot on the locating pins 120. In other instances, the entire magazine 10 may have to be removed from the tool 12. The type of fastener 14 can be changed easily while working by releasing the mounting bracket 126 and lifting the magazine from the locating pins 120. The new magazine 10 is obtained, the locating pins 120 aligned with and inserted into the holes 114, and affixing the mounting bracket 116. With the magazine 10 removed, the front wear plate 144 and rear wear plates 146 can be changed as necessary to accommodate a different workpiece contact element 138 or different channel 90.

While a particular embodiment of the detachable magazine for a tool has been shown and described, it will be appreciated by those skilled in the art that changes and modifications may be made thereto without departing from the invention in its broader aspects and as set forth in the following claims.

What is claimed is:

1. A tool for driving a fastener from a detachable magazine, comprising:

a tool housing;

a power source enclosed by said housing;

a nosepiece attached to said housing and having a channel and a first alignment structure; and a magazine removably attached to said tool and having a magazine housing with a proximal end and a distal end, and a shear block mounted to said proximal end of said magazine housing, said shear block having a second alignment structure and a face such that said channel and said face form a barrel when said first alignment structure is engaged with said second alignment structure and said magazine is removably attached to said tool, such that the fastener is propelled by said power source, through said barrel and into the workpiece.

2. The tool of claim 1, wherein said magazine housing comprises at east a first side rail and a second side rail.

3. The tool of claim 2, wherein said first side rail comprises a top edge, a bottom edge, proximal end and a distal end;

said second side rail having top edge, a bottom edge, a proximal end and a distal end, said bottom edge being removably attachable to the top edge of said first side rail without the use of a fastener.

4. The tool of claim 2 wherein said shear block is sandwiched between said proximal ends of said first and second side rails.

5. The tool of claim 4, wherein said shear block further comprises at least one leg sandwiched between said first and second side rails and extending from said proximal end of said side rails toward said distal end of said side rails.

6. The tool of claim 4 wherein said shear block comprises a first positioning element engagable with a second positioning element on at least one of said first and second side rails.

7. The tool of claim 6, wherein said first positioning element is located on said leg.

8. The tool of claim 7, wherein said first positioning element comprises a boss, a projection or a shoulder.

9. The tool of claim 8, wherein said first positioning element is a cylindrical projection.

10. The tool of claim 4, further comprising a fastening means connecting said top edge of said first side rail to said top edge of said second side rail when said shear block is sandwiched between said first and second side rails.

11. The tool of claim 10, wherein said fastening means comprises an end cap.

12. The tool of claim 2, wherein said first side rail and said second side rail are provided with a complimentary tongue and groove configuration.

13. The tool of claim 1 further comprising an end cap removably attached to said magazine at said distal end of said first and second side rails.

14. The tool of claim 13, wherein said end cap further comprises a shelf to guide a plurality of fasteners into said magazine.

15. The tool of claim 1, wherein said shear block further comprises marks that indicate the depth of penetration of said fastener.

16. A detachable magazine for a tool for driving fasteners, comprising:

a first side rail having a top edge, a bottom edge, proximal end and a distal end;

a second side rail having top edge, a bottom edge, a proximal end and a distal end, said bottom edge of said second side rail being removably attachable to the bottom edge of said first side rail without the use of a connector; and an end cap that frictionally fits over said distal end of said first side rail and said distal end of said second side rail to hold said magazine housing together.

17. The tool of claim 16, wherein said bottom edge of said first side rail is removably attached to said bottom edge of said second side rail using a tongue and groove.

18. The tool of claim 16 further comprising at least one window in one of said first and second side rails.

19. The tool of claim 18, wherein said end cap comprises a lock on a prong that engages with said window when said end cap is removably attached to said magazine.

20. The tool of claim 16 further comprising a follower assembly, held between said left side rail and said right side rail of said magazine, that sequentially loads the fasteners into said tool, said first side rail and said second side rail being sized and configured to hold said follower assembly and a plurality of fasteners between them.

21. A tool for driving a fastener from a detachable magazine into a workpiece, comprising:

a tool housing;

a power source enclosed by said housing;

a nosepiece attached to said housing and having a front wear plate comprising a workpiece contact element and a rear wear plate comprising a channel, said workpiece contact element having an interlock with said power supply to provide power only if said workpiece contact element is in contact with the workpiece; and a magazine having a face and a fastener supply, such that, when said magazine is removably attached to said tool, the fastener supply supplies a fastener to a barrel that is formed by said channel and said face and the fastener is driven into the workpiece when power from said power supply is applied to the fastener.

22. A tool for driving a fastener from a detachable magazine, comprising:

a tool housing;

a means for providing power to said tool;

a nosepiece attached to said housing and having a channel and a first alignment means; and a magazine removably attached to said tool and having a magazine housing and a shear block, said magazine housing having a proximal end and a distal end, said shear block being mounted to said proximal end of said magazine housing, said shear block having a second alignment means and a face such that said channel and said face form a barrel when said first alignment means is engaged with said second alignment means and said magazine is removably attached to said tool, such that the fastener is propelled by said power means, through said barrel and into the workpiece.

* * * * *